US009771243B2

(12) United States Patent
Kattainen et al.

(10) Patent No.: US 9,771,243 B2
(45) Date of Patent: Sep. 26, 2017

(54) ELEVATOR SAFETY ARRANGEMENT FOR CONTROLLING ELEVATOR MOVEMENT

(71) Applicant: KONE Corporation, Helsinki (FI)

(72) Inventors: Ari Kattainen, Hyvinkää (FI); Antti Hovi, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 468 days.

(21) Appl. No.: 14/484,491

(22) Filed: Sep. 12, 2014

(65) Prior Publication Data

US 2015/0083528 A1 Mar. 26, 2015

(30) Foreign Application Priority Data

Sep. 26, 2013 (FI) ..... 20135963

(51) Int. Cl.
*B66B 1/34* (2006.01)
*B66B 5/06* (2006.01)
*B66B 5/00* (2006.01)

(52) U.S. Cl.
CPC ..... *B66B 5/06* (2013.01); *B66B 1/3492* (2013.01); *B66B 5/0006* (2013.01); *B66B 5/0031* (2013.01); *B66B 5/0037* (2013.01)

(58) Field of Classification Search
CPC ..... B66B 5/06; B66B 1/3492; B66B 5/006; B66B 5/0031; B66B 5/0037; B66B 5/0006
USPC ..... 187/247, 277, 391, 393, 394, 288, 289, 187/293, 296, 297
See application file for complete search history.

(56) References Cited

U.S. PATENT DOCUMENTS 5,421,432 A * 6/1995 Strambi ..... B66B 1/285 187/288
5,587,566 A * 12/1996 Barten ..... G05B 19/416 187/247
5,637,841 A * 6/1997 Dugan ..... B66B 1/30 187/291
5,804,779 A * 9/1998 Fargo ..... G05B 19/416 187/293
5,859,395 A * 1/1999 Fargo ..... G05B 19/416 187/293

(Continued)

FOREIGN PATENT DOCUMENTS

EP 1 885 640 A1 2/2008
IT 1208257 B 6/1989

(Continued)

*Primary Examiner* — Anthony Salata
(74) *Attorney, Agent, or Firm* — Birch, Stewart, Kolasch & Birch, LLP

(57) ABSTRACT

A method and a safety arrangement are provided for monitoring the movement of an elevator component, more particularly of an elevator car or of the automatic door of an elevator. In the method, a setup drive of an elevator component is run, and the speed and/or acceleration of the elevator component is measured during the setup drive, a threshold value for the speed and/or acceleration of the elevator component is formed on the basis of the measuring data obtained in the setup drive, the speed and/or acceleration of the elevator component is measured, and if the measured speed and/or acceleration exceeds the aforementioned threshold value, a monitoring signal for bringing the elevator to a safe state is formed.

20 Claims, 3 Drawing Sheets

(56) References Cited

U.S. PATENT DOCUMENTS

Figure 2:
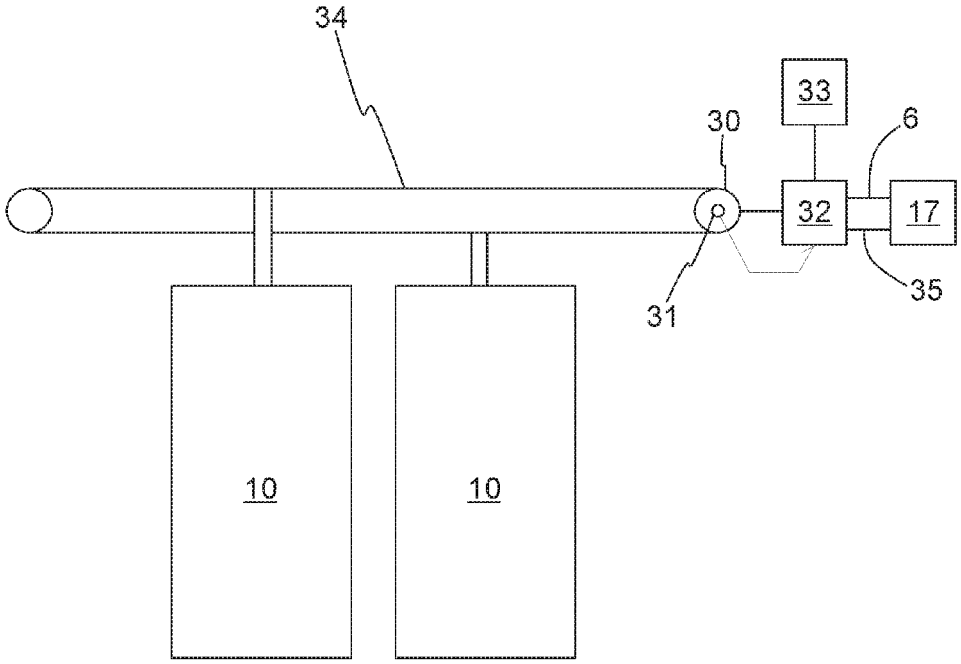

| | | | | |
|---|---|---|---|---|
| 7,117,979 | B2 * | 10/2006 | Angst | B66B 1/285 187/286 |
| 7,353,916 | B2 * | 4/2008 | Angst | B66B 5/0031 187/314 |
| 7,497,303 | B2 * | 3/2009 | Maccioni | B66C 13/40 187/391 |
| 7,533,763 | B2 * | 5/2009 | Kattainen | B66B 1/28 187/287 |
| 7,775,329 | B2 * | 8/2010 | Eckenstein | B66B 1/32 187/277 |
| 7,823,706 | B2 * | 11/2010 | Tyni | B66B 5/0031 187/391 |
| 7,971,688 | B2 * | 7/2011 | Perala | B66B 1/3407 187/293 |
| 2004/0173413 | A1 | 9/2004 | Angst et al. | |
| 2008/0230326 | A1 | 9/2008 | Tyni et al. | |

FOREIGN PATENT DOCUMENTS

| | | | |
|---|---|---|---|
| WO | WO 00/37348 | A1 | 6/2000 |
| WO | WO 2006/106174 | A1 | 10/2006 |
| WO | WO 2011/042612 | A1 | 4/2011 |
| WO | WO 2011/086230 | A1 | 7/2011 |

* cited by examiner

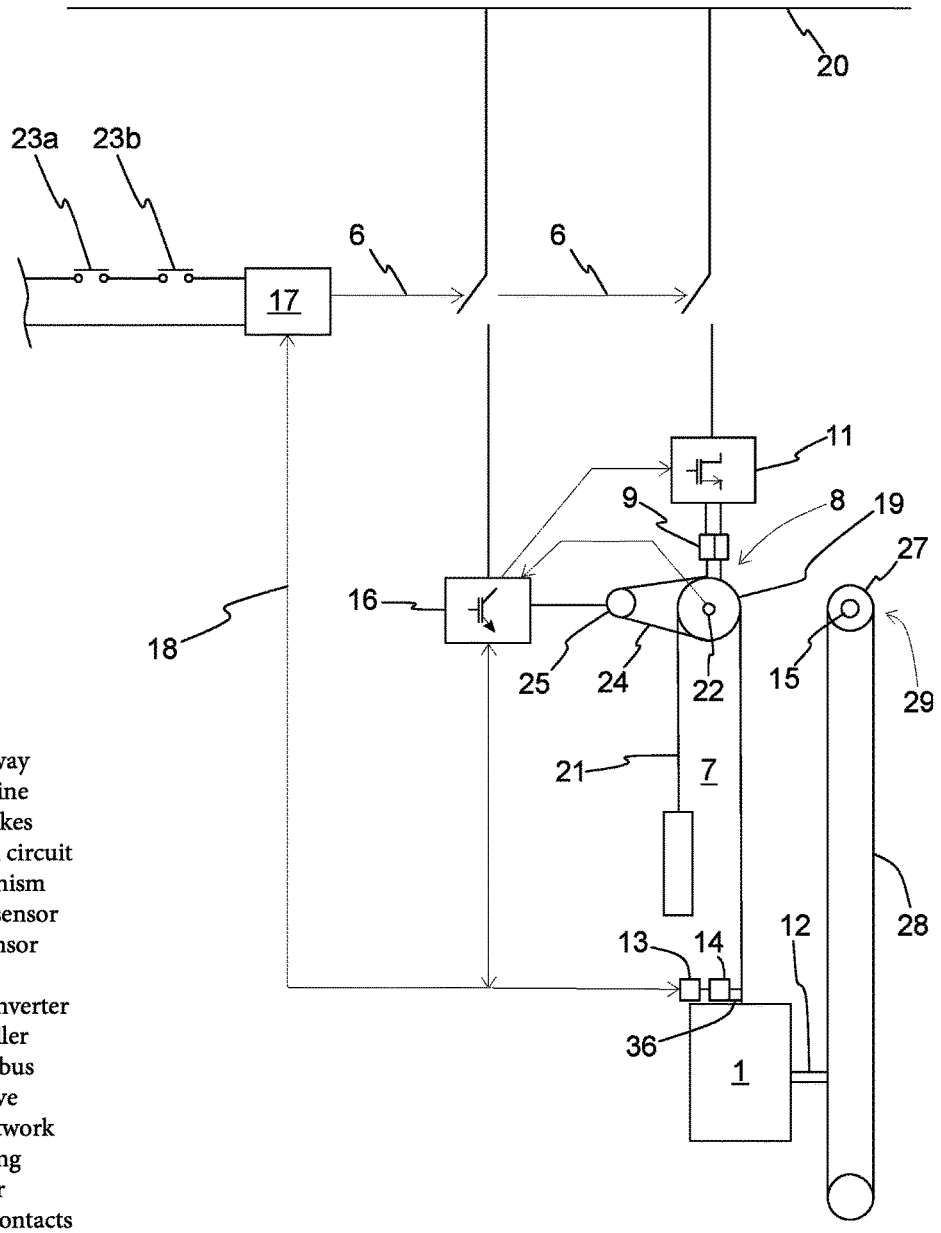

1 - elevator car
6 - safety signal
7 - elevator hoistway
8 - hoisting machine
9 - machinery brakes
11 - brake control circuit
12 - safety mechanism
13 - acceleration sensor
14 - door zone sensor
15 - encoder
16 - frequency converter
17 - safety controller
18 - data transfer bus
19 - traction sheave
20 - electricity network
21 - hoisting roping
22 - pulse encoder
23a, 23b - safety contacts
24 - traction belt
25 - electric motor
27 - rope pulley
28 - rope
29 - overspeed governor
36 - microcontroller

Fig.1

6 - safety signal
10 - door panels
17 - electronic safety controller
30 - traction sheave
31 - pulse encoder
32 - frequency converter
33 - control unit
34 - traction belt
35 - data transfer bus

ELEVATOR SAFETY ARRANGEMENT FOR CONTROLLING ELEVATOR MOVEMENT

FIELD OF THE INVENTION

The invention relates to the safety of elevators and more particularly to solutions for monitoring the movement of an elevator component, more particularly of an elevator car or an automatic door.

BACKGROUND OF THE INVENTION

For avoiding an accident situation, an elevator car has a safety mechanism that stops the movement of a falling elevator car by gripping hold of a guide rail of the elevator car. Generally the safety mechanism is designed in such a way that it is able to stop only a downward-moving elevator car. The safety mechanism is usually activated by an overspeed governor. The overspeed governor can be disposed in the elevator hoistway or in a machine room. The overspeed governor is connected to the safety mechanism with a rope, which runs around a freely rotating rope pulley of the overspeed governor. The safety mechanism is activated by stopping the movement of the rope pulley/rope when the elevator car is moving downwards. The overspeed governor has an activation means based on centrifugal force, which means activates the safety mechanism by locking the rope pulley into its position when the speed of the elevator car/rope pulley reaches a certain threshold value.

In newer elevators a safety contact, which is in the safety circuit of the elevator, is fitted in connection with the activation means functioning with centrifugal force. The safety contact opens with the control of the activation means, generally slightly before the locking of the rope pulley. Opening of a safety contact causes an emergency stop of the elevator, in which case the machinery brakes engage to brake the traction sheave of the hoisting machine of the elevator and the power supply to the electric motor of the hoisting machine is disconnected. Unlike the aforementioned safety mechanism, the machinery brakes are also able to stop the upward movement of the elevator car.

Installation of a safety contact in the overspeed governor of an old elevator does not usually succeed in a sufficiently reliable manner, in which case upgrading the safety of an old elevator to conform to current requirements is contingent on replacement of both the overspeed governor and possibly also the safety mechanism of the elevator car. This increases the work phases and costs in the modernization of an elevator.

The speed of an elevator car can increase to be very high before the overspeed monitoring of the overspeed governor functions. For example, the speed of an elevator having a rated speed of 1 m/s can accelerate to a value of 1.5 m/s before the speed of the elevator car starts to decelerate. Such a high speed can be a safety risk e.g. to a serviceman who is driving a service drive with the elevator car while on the roof of the elevator car.

Normally in the elevator hoistway are limit switches on both sides of a stopping floor, the purpose of which limit switches is to prevent the elevator car drifting away from the stopping floor when the doors are open. The arrival of the elevator car at a limit switch when the doors are open activates the machinery brakes of the hoisting machine and/or the safety mechanism of the elevator car, in which case the movement of the elevator car stops. After this the elevator is also removed from use for safety reasons.

Before arriving at a limit switch from its last stop, the elevator car has already had time to travel a distance that produces an appreciable step between the floor of the elevator car and the stopping floor. A step is a tripping risk and injury risk to passengers crossing it. In addition, a step hampers the unloading of a load from the elevator car.

The automatic door of an elevator is opened and closed by driving the door panels with an electric motor. The speed of the door panels is adjusted by adjusting the current of the electric motor with a control unit. In an error situation the speed of the door panels can change suddenly, which might feel disturbing to a person walking through the door.

Aim of the Invention

The aim of the invention is to solve the aforementioned problems as well as the problems disclosed in the description below.

The preferred embodiments of the invention are described in the dependent claims. Some inventive embodiments and inventive combinations of the various embodiments are also presented in the descriptive section and in the drawings of the present application.

SUMMARY OF THE INVENTION

One aspect is a method for monitoring the movement of an elevator car. In the method a setup drive of the elevator car is run, and the speed and/or acceleration of the elevator car is measured during the setup drive, a threshold value for the speed and/or acceleration of the elevator car is formed on the basis of the measuring data for speed/acceleration obtained in the setup drive, the speed and/or acceleration of the elevator car is measured after the setup drive, and if the measured speed and/or acceleration exceeds the aforementioned threshold value, a monitoring signal for bringing the elevator to a safe state is formed.

When the threshold value for the speed and/or acceleration of the elevator car is formed on the basis of measuring data obtained in a setup drive, i.e. on the basis of the speed and/or acceleration of the elevator car measured in the setup drive, the threshold value can be set closer to the run speed of the elevator car than known art without this causing unnecessary emergency stops. This is because speed fluctuations of the elevator car belonging to the normal operation of the elevator will in this case be measured and taken into account in forming the aforementioned threshold value.

These types of speed fluctuations belonging to normal operation are, inter alia, speed overruns caused by a response of the speed regulator of the elevator car, fluctuations caused in the speed of the elevator car from the control of an open loop, et cetera. Also taken into account will be e.g. scaling errors and offset errors of the speed/acceleration measuring apparatus, unit-specific variation of speed/acceleration sensors, et cetera. This all means that the threshold value indicating overspeed can be set e.g. to be approx. 5 percent greater than the measured speed of the elevator car, when conventionally the threshold value has had to be set to be approx. 10 greater than the measured speed, so that the aforementioned unnecessary emergency stops can be eliminated.

In some improvements a setup drive is driven starting to move from a terminal floor of the elevator hoistway and stopping at the opposite terminal floor.

In some improvements an emergency stop of the elevator car is started on the basis of the monitoring signal to be formed. This means that an emergency stop can be started reliably and faster than before in a situation in which the movement of the elevator car differs from that desired. In some alternative improvements the run speed of the elevator car is reduced on the basis of the monitoring signal to be formed. This means that a run with the elevator can still be continued to the original destination floor despite the activation of monitoring.

In some improvements two threshold values of different magnitudes for the speed of the elevator car are formed on the basis of the measuring data acquired in the setup drive, and if the measured speed of the elevator car exceeds the first threshold value, the electric motor of the hoisting machine of the elevator and/or the machinery brakes of the hoisting machine are controlled for bringing the elevator car into a safe state, and if the measured speed of the elevator car further exceeds the second, larger threshold value, a safety mechanism of the elevator car is activated. This can mean that at first an emergency stop is started by means of the electric motor and/or machinery brakes, and if this is not sufficient to stop the elevator car, a safety mechanism of the elevator car, with which the elevator car grips hold of a guide rail, is also activated. When using a safety mechanism the deceleration of the elevator car is usually greater than when using an electric motor/machinery brakes, so that by means of the improvement the deceleration of an elevator car can be reduced in situations in which the electric motor/machinery brakes are sufficient to stop the movement of the elevator car. This is preferred because greater deceleration might feel unpleasant from the viewpoint of the passengers in the elevator car.

In some improvements the acceleration of the elevator car is measured with an acceleration sensor of the elevator car, and also speed information of the elevator car is formed by integrating the measuring data of the acceleration sensor. In this way undesirable acceleration as well as undesirable speed of the elevator car can be reliably detected. In particular undesirable acceleration can also be identified almost immediately it arises.

A second aspect is a safety arrangement of an elevator, comprising a movement measuring sensor, more particularly a position sensor and/or a speed sensor and/or an acceleration sensor, which is connected to measure the movement of the elevator car, a motor drive for driving the elevator car, a safety controller, which is connected to the motor drive for bringing the elevator to a safe state, and also a data transfer channel formed between the motor drive, the movement measuring sensor and the safety controller. The safety controller comprises a processor and also a memory, in which is a program to be executed with the processor, wherein the safety controller is configured to receive from the movement measuring sensor measuring data about the speed and/or acceleration of the elevator car during the setup drive, to form a threshold value for the speed and/or acceleration of the elevator car on the basis of the aforementioned measuring data, to receive from the movement measuring sensor measuring data about the speed and/or acceleration of the elevator car after the setup drive, and if the measuring data being received in this case exceeds the aforementioned threshold value, to form a monitoring signal for bringing the elevator to a safe state. With this type of apparatus the solution, according to the description, for monitoring the movement of an elevator car can be implemented in a safe manner.

In some improvements the safety controller is connected to the motor drive driving the elevator car for emergency stopping of the elevator car.

In some improvements the safety controller is connected to the safety mechanism of the elevator car for activating the safety mechanism.

A third aspect is a method for monitoring the movement of an automatic door of an elevator. In the method a setup drive of the automatic door of an elevator is run, and the speed and/or acceleration of the automatic door of the elevator is measured during the setup drive, a threshold value for the speed and/or acceleration of the automatic door of the elevator is formed on the basis of the measuring data for speed/acceleration acquired in the setup drive, the speed and/or acceleration of the automatic door of the elevator is measured after the setup drive, and if the measured speed and/or acceleration in this case exceeds the aforementioned threshold value, a monitoring signal for bringing the elevator to a safe state is formed.

When the threshold value for the speed and/or acceleration of an automatic door of an elevator is formed on the basis of measuring data obtained in a setup drive, i.e. on the basis of the speed and/or acceleration of the automatic door of the elevator measured in the setup drive, the threshold value can be set closer to the drive speed of the automatic door of the elevator than known art, because the speed fluctuations belonging to the normal operation of an automatic door will in this case be measured and taken into account in forming the aforementioned threshold value. These types of speed fluctuations belonging to normal operation are, inter alia, speed overruns caused by a response of the speed regulator of the automatic door, fluctuations caused in the speed of an automatic door of an elevator from the control of an open loop, et cetera. Also taken into account will be e.g. scaling errors and offset errors of the speed/acceleration measuring apparatus, unit-specific variation of speed/acceleration sensors, et cetera. This all means that the threshold value indicating undesired movement can be set e.g. to be approx. 5 percent greater than the measured speed of an automatic door of an elevator, in which case the reaction to undesired movement of the automatic door can be faster than before.

A fourth aspect is a safety arrangement of an elevator, comprising a movement measuring sensor, more particularly a position sensor and/or a speed sensor and/or an acceleration sensor, which is connected to measure the movement of an automatic door of an elevator, a motor drive for driving the automatic door of the elevator, a safety controller, which is connected to the motor drive for bringing the elevator to a safe state, and also a data transfer channel formed between the motor drive, the movement measuring sensor and the safety controller. The safety controller comprises a processor and also a memory, in which is a program to be executed with the processor, wherein the processor is configured to receive from the movement measuring sensor measuring data about the speed and/or acceleration of the automatic door of the elevator during a setup drive, to form a threshold value for the speed and/or acceleration of the automatic door of the elevator on the basis of the aforementioned measuring data, to receive from the movement measuring sensor measuring data about the speed and/or acceleration of the automatic door of the elevator after the setup drive, and if the measuring data being received in this case exceeds the aforementioned threshold value, to form a monitoring signal for bringing the elevator to a safe state. With this type of apparatus the solution, according to the description, for monitoring the movement of an automatic door of an elevator can be implemented in a safe manner.

As a result of the solution according to the description, undesired movement of an elevator component, more precisely of an elevator car or of an automatic door, can be detected faster than in prior art. As a result of this the reaction to the undesired movement can also be faster, in which case the elevator can be brought into a safe state already before the undesired movement causes arm.

In the following description the term elevator component refers to an elevator car and/or to an automatic door.

In some improvements a monitoring function is formed for monitoring the speed and/or acceleration of an elevator component, the monitoring function is initialized into a state in which the monitoring function is not in use, one or more pass criteria are determined for passing the setup drive, and the monitoring function is taken into use after fulfilling the aforementioned one or more pass criteria.

In some improvements samples are taken of the speed and/or acceleration of the elevator component during the setup drive, and the maximum value during the setup drive is ascertained from the samples taken of the speed and/or acceleration of the elevator component, and a threshold value is formed for the speed and/or acceleration of the elevator component on the basis of the aforementioned maximum value during the setup drive. This means that a constant value is used as a threshold value, which is formed on the basis of the aforementioned maximum value of the speed and/or acceleration of the elevator component during the setup drive.

In some improvements a speed reference for the elevator component is formed for the setup drive, the speed of the elevator component is adjusted with the motor drive to be according to the speed reference during the setup drive, a scaling factor is formed, which connects the aforementioned speed reference to the speed and/or acceleration during the setup drive, and a threshold value for the speed and/or acceleration of the elevator component is formed as a function of the speed reference by means of the aforementioned scaling factor. When the threshold value is formed as a function of the speed reference, calculation of the threshold value is easier. Since the speed reference is different in different drive modes (e.g. in normal drive of the elevator the speed reference is of a different magnitude than in a service drive of the elevator), a threshold value for different drive modes can in this case be easily formed by means of the speed reference.

In some improvements a speed reference is formed as a function of the position of the elevator component and a threshold value for the speed and/or acceleration as a function of the speed reference is formed by means of the aforementioned scaling factor. This means that a threshold value can change as a function of the position of an elevator component, in which case the speed/acceleration of the elevator component can be monitored as a function of the position of the elevator component, which increases the reliability of the monitoring of the movement of the elevator component.

BRIEF EXPLANTATION OF THE FIGURES

FIG. 1 presents as a block diagram a safety arrangement of an elevator according to one embodiment.

FIG. 2 presents as a block diagram a safety arrangement of an elevator according to a second embodiment.

Figure 3A:
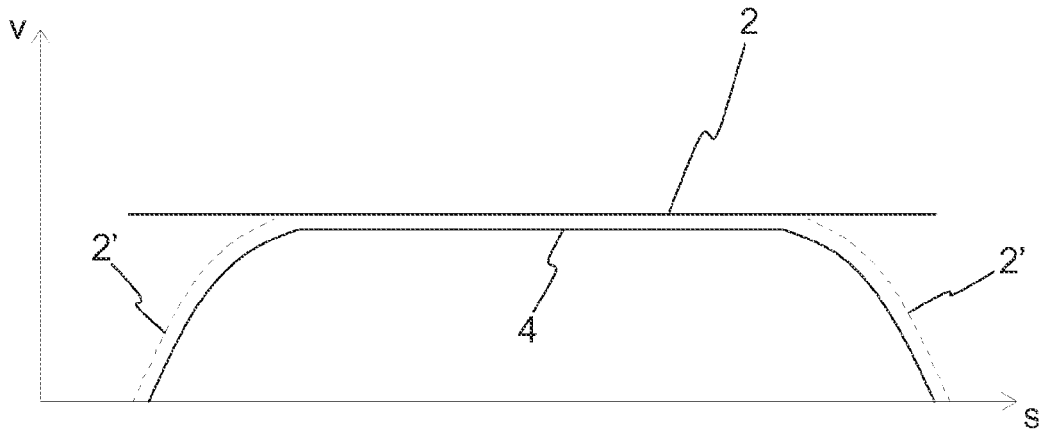

FIG. 3*a* illustrates a threshold value for speed according to the first or second embodiment.

Figure 3B:
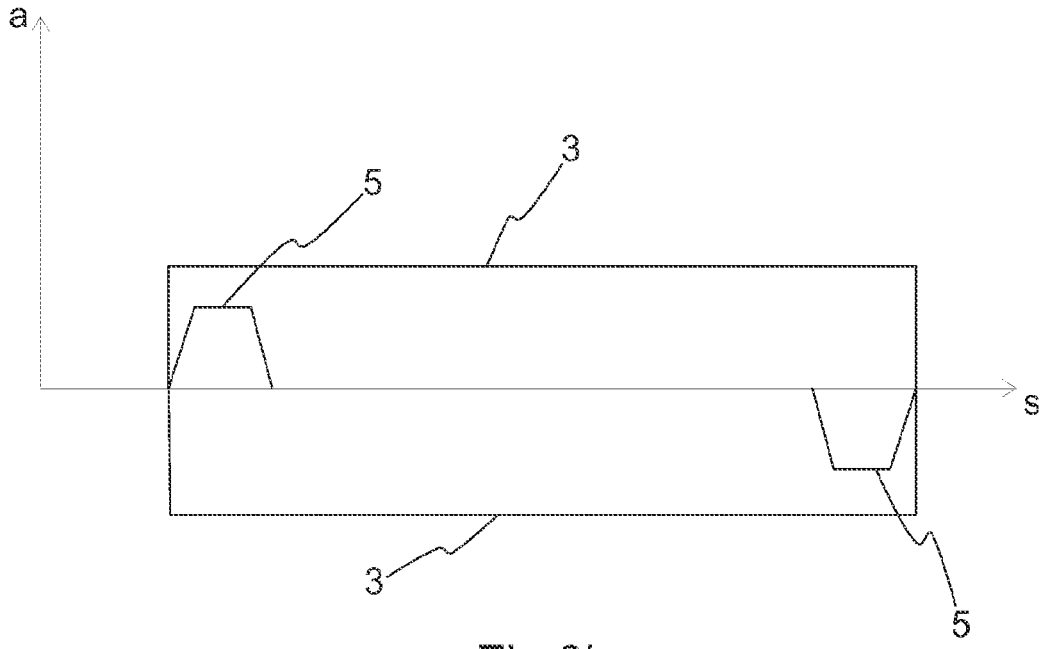

FIG. 3*b* illustrates a threshold value for acceleration according to the first or second embodiment.

MORE DETAILED DESCRIPTION OF PREFERRED EMBODIMENTS OF THE INVENTION

For the sake of clarity, FIGS. 1-3 endeavors to present only the features that are essential from the viewpoint of understanding the invention. Consequently e.g. some generally known parts belonging to an elevator are not necessarily presented in the figures if the presentation of them is not significant from the viewpoint of understanding the invention.

In the description the same reference numbers are always used for the same parts and functions.

As a person skilled in the art can ascertain when becoming acquainted with the description, the terms "acceleration of an/the elevator car" or "acceleration of an/the automatic door" are used in the description in certain situations also to refer to the deceleration of an/the elevator car or to the deceleration of an/the automatic door, respectively.

FIG. 1 presents a safety arrangement in an elevator, in which the elevator car 1 is driven in the elevator hoistway 1 with a motor drive in such a way that the elevator car 1 stops at the floors determined by service requests given by elevator passengers. The motor drive comprises a hoisting machine 8 of the elevator and also a frequency converter 16. The elevator car 1 is driven by pulling the hoisting roping 21 of the elevator with the traction sheave 19 of the hoisting machine 8. The traction sheave 19 is rotated by an electric motor 25 in the hoisting machine 8, by supplying current to the electric motor 25 from the electricity network 20 with a frequency converter 16. The electric motor 25 can be e.g. a permanent-magnet synchronous motor, an induction motor or a reluctance motor, or otherwise also a direct-current motor. The electric motor 25 is connected to the traction sheave 19 with a traction belt 24 in such a way that the axes of rotation of the electric motor 25 and of the traction sheave 29 are situated side by side. In some alternative solutions the electric motor 25 and the traction sheave 19 are situated consecutively on the same axis of rotation, in which case a traction belt 24 is not needed. In the solution of FIG. 1 the hoisting machine 8 is disposed in the top part of the elevator hoistway 7, but the hoisting machine could also be disposed e.g. at the side of the vertical path of movement of the elevator car 1 or in a pit below the elevator hoistway 7. On the other hand, the hoisting machine 8 can also be disposed in a separate machine room.

A microprocessor is fitted in connection with the frequency converter 16, which microprocessor calculates the speed reference $v_{ref}$ of the elevator car 1, i.e. the target speed for movement of the elevator car 1 in the elevator hoistway 7. The frequency converter 16 measures the speed of rotation of the traction sheave 19 with a pulse encoder 22 and adjusts the measured speed of the traction sheave 19 towards the speed reference by adjusting the current of the electric motor 25 of the hoisting machine 8.

The hoisting machine 8 also comprises two electromagnet machinery brakes 9. The machinery brakes 9 are kept open by supplying electric power with the brake control circuit 11 to the electromagnets of the machinery brakes 9, and the machinery brakes 9 are connected to mechanically brake the traction sheave 19 of the hoisting machine by disconnecting the electricity supply to the electromagnets of the machinery brakes 9.

For avoiding an accident situation, an elevator car 1 has a safety mechanism 12 that stops the movement of a falling elevator car 1 by gripping hold of a guide rail of the elevator car 1. The safety mechanism 12 is designed in such a way that it is able to stop only a downward-moving elevator car 1. The safety mechanism 12 is activated by the overspeed governor 29. In the elevator of FIG. 1, the overspeed governor 29 is situated in the top part of the elevator hoistway 7. The overspeed governor 29 is connected to the safety mechanism 12 with a rope 28, which runs around the rope pulley 27 of the overspeed governor 29. The rope pulley 27 is able to rotate freely during normal operation of the elevator. The safety mechanism 12 is activated by stopping the movement of the rope pulley 27, in which case also the movement of the rope 28 stops. If the elevator car 1 moves downwards when the rope 28 stops, the safety mechanism 12 displaces into the gripping position and the elevator car 1 stops by gripping hold of a guide rail.

The safety arrangement of FIG. 1 comprises positive opening safety contacts 23*a*, 23*b*, which are situated to monitor the safety of selected points in the elevator. With the safety contacts 23*a*, 23*b* e.g. the state of the entrances of the elevator hoistway 7 can be monitored, as can also: the extreme limits of permitted movement of the elevator car 1 in the elevator hoistway 7, the operation of the overspeed governor 29 of the elevator, the position of the car door of the elevator, the state of the end buffers of the elevator hoistway 7, temporary service spaces to be formed in the elevator hoistway 7, the state of the safety mechanism 12 to be activated with the overspeed governor 29, et cetera. The opening of a safety contact 23*a*, 23*b* indicates a functional nonconformance, such as endangerment of the safety of a monitored point.

The safety arrangement also comprises an electronic safety controller 17. The safety controller 17 is an electronic programmable safety device that can comprise at least two microprocessors having their own memories, the softwares recorded in which the microprocessors execute independently of each other. The safety controller 17 is designed and programmed to follow the safety regulations in use in the field that are required of the safety devices of an elevator.

The safety contacts 23*a*, 23*b* of the elevator are conducted to the electronic safety controller 17, and the electronic safety controller 17 is configured to read the state of the safety contacts 23*a*, 23*b*. Between the safety controller 17 and the frequency converter 16 is a data transfer bus 18, which data transfer bus 18 is also taken via a traveling cable onwards to the elevator car 1. On the elevator car 1 is a microcontroller 36, which reads the measuring signal of the acceleration sensor 13 of the elevator car and also calculates by integration the speed of the elevator car 1 and the distance traveled by the elevator car 1 from the acceleration data. The microcontroller 36 also reads the measuring data from the door zone sensor 14, which indicates the position of the elevator car 1 at the point of a hoistway door in the elevator hoistway 12 as well as information about which floor the elevator car 1 is situated at. In addition, the microcontroller 36 calculates from the data received from the door zone sensor 14 the speed of the elevator car 1 always when the elevator car 1 passes a hoistway door in the elevator hoistway. The solution described in e.g. patent publication WO 2011/042612 A1 can be used as a door zone sensor 14.

Since there can be an error in the speed data and position data integrated from the measuring signal of the acceleration sensor 13, the microcontroller 36 always corrects the integrated speed data and position data when it receives from a door zone sensor 14 information about the speed and position of the elevator car 1 when the elevator car 1 passes a hoistway door. The microcontroller 36 sends the processed measuring data for the acceleration, speed and position of the elevator car to the data transfer bus 18, and the safety controller 17 receives from the data transfer bus 18 the measuring data sent by the microcontroller 36. The safety controller 17 monitors the operation of the elevator from the safety contacts 23*a*, 23*b* and also on the basis of measuring data being received via the data transfer bus 18. The safety controller 17 brings the elevator to a safe state if the measuring data received indicates that the safety of the elevator is endangered.

The data transfer bus 18 is preferably a serial interface bus, such as a CAN bus, LON bus, RS 485 bus, or corresponding. On the other hand the data transfer bus 18 can also be a wireless radio connection. Most preferably the data transfer channel 18 is implemented as a time-division protocol in such a way that the safety controller 17 receives measuring data from the data transfer bus at regular intervals.

The safety controller 17 comprises a relay output for the safety signal 6. If necessary, the safety controller 17 brings the elevator to a safe state by disconnecting the aforementioned safety signal 6 by opening the contacts of a safety relay that is in the safety controller 17. When the safety signal 6 is disconnected, the machinery brakes 9 engage to brake the traction sheave 19 of the hoisting machine and the current supply to the electric motor 25 of the hoisting machine ceases.

The safety controller 17 monitors that the movement of the elevator car 1 follows the desired movement. The safety controller 17 compares the measuring data of the speed and acceleration of the elevator car that it has received from the microcontroller 36 of the elevator car to the threshold value recorded in the memory of the safety controller 17. If the measured speed/acceleration of the elevator car 1 exceeds the threshold value recorded in memory, the safety controller 17 performs the necessary procedures for bringing the elevator to a safe state.

In some embodiments two separate acceleration sensors 13 are fitted to the elevator car, and the safety controller 17 receives from the data transfer bus 18 acceleration measuring data from both acceleration sensors 13 separately. In this case a failure of an acceleration sensor 13 can be detected by comparing the measuring data being received from the different sensors 13.

In some embodiments the speed/acceleration of the elevator car is measured with an encoder 15, which is connected to measure the movement of the rope pulley 27 of the overspeed governor 29.

In some embodiments the speed/acceleration of the elevator car is measured with a magnetic strip suspended in the elevator hoistway 7. The absolute position, which is read by a reader that is on the elevator car 1, is coded into the strip.

The safety controller 17 forms a threshold value for the monitoring of movement before the elevator is taken into normal operation. In normal operation the movement of the elevator car 1 is monitored by the safety controller 17, using the threshold value in the monitoring.

Before the elevator is taken into normal operation, a setup drive is run with the elevator while subjected to monitoring by the safety controller 17. In the setup drive the elevator car 1 starts to move from a terminal floor of the elevator hoistway 7, drives at normal speed through the elevator hoistway 7, and stops at the opposite terminal floor.

A microprocessor that is in connection with the frequency converter 16 calculates the speed reference $v_{ref}$ of the elevator car for the setup drive. The frequency converter 16 measures the speed of rotation of the traction sheave 19 with a pulse encoder 22 and adjusts the measured speed of the traction sheave 19 to be according to the speed reference $v_{ref}$ by adjusting the current of the electric motor 25 of the hoisting machine 8.

The safety controller 17 during the setup drive regularly receives from the microcontroller 36 of the elevator car the processed measuring data of the acceleration sensor 13/door zone sensor 14 of the elevator car and it records the measuring data received as a set of samples in the memory of the safety controller 17. At the same time the safety controller 17 monitors the progress of the setup drive from the safety contacts 23*a*, 23*b* and by means of the data being received from the other sensors. If the safety controller 17 concludes there is a functional nonconformance, the safety controller 17 aborts the setup drive. This type of functional nonconformance can be e.g. the opening of a safety contact 23*a*, 23*b* of the elevator during the setup drive. The reason for this can be e.g. the activation of the overspeed governor 29 or the opening of a hoistway door. One reason for a functional nonconformance can also be an error detected by the frequency converter 16, such as a control error or overspeed of the traction sheave, et cetera. Taking the elevator into use is dependent on successfully passing the setup drive, so an aborted setup drive must be performed again.

When the setup drive has been successfully passed, the safety controller 17 takes into use the movement monitoring function, according to the description, of the movement of the elevator car 1. The safety controller 17 forms the threshold values for the speed and acceleration of the elevator car that are needed in the monitoring function on the basis of the set of samples of the measuring data recorded in memory in the setup drive.

In one embodiment the safety controller 17 ascertains from the set of samples recorded in memory the maximum values during the setup drive for the speed and acceleration of the elevator car 1. The safety controller 17 forms a threshold value for the speed of the elevator car in such a way that the threshold value is a constant value, which is 5 percent greater than the maximum value of the speed of the elevator car 1 measured by the microcontroller 36 of the elevator car during the setup drive. The safety controller also forms a threshold value for the acceleration of the elevator car in such a way that the threshold value for acceleration is a constant value, which is most preferably 25-50 percent greater than the maximum value of the acceleration of the elevator car 1 measured by the microcontroller 36 of the elevator car during the setup drive.

In a further developed embodiment the frequency converter 16 sends to the safety controller 17 a speed reference $v_{ref}$ from the even speed run phase of the setup drive. The safety controller 17 ascertains the maximum value $v_{max}$ for the speed of the elevator car 1 from the set of samples recorded in memory from the even speed run phase. The safety controller 17 calculates the elevator-specific scaling factor k by means of the maximum value $v_{max}$ for speed and by means of the speed reference $v_{ref}$:

$$k = \frac{v_{max}}{v_{ref}}.$$

The safety controller determines the threshold value $v_{lim}$, for speed in such a way that the threshold value is 5 percent greater than $v_{max}$, in which case a description is obtained for the threshold value $v_{lim}$ as a function of the speed reference $v_{ref}$, using the scaling factor k as an aid:

$$v_{lim}=1.05*k*v_{ref}$$

The scaling factor k is an elevator-specific constant, which comprises elevator-specific information about, inter alia, a speed overrun causing a response of the speed regulator of the elevator car, fluctuation caused in the speed of the elevator car from the control of an open loop, scaling errors and offset errors of the speed/acceleration measuring apparatus, unit-specific variation of speed/acceleration sensors, et cetera. When the scaling factor k has been formed once, the equation above can after this always be used in the calculation of the threshold value $v_{lim}$, so the threshold value in different drive modes (e.g. normal drive, service drive, rescue drive) for the different run speeds needed can be determined as a function of the speed reference $v_{ref}$ without separate setup drives. It must be noted that in the equation above the speed reference can also change as a function $v_{ref}(s)$ of the position s of the elevator car, in which case the threshold value $v_{lim}$ can be determined as a function of the position s of the elevator car:

$$v_{lim}(s)=1.05*k*v_{ref}(s)$$

In a further developed embodiment the safety controller 17 regularly receives from the frequency converter 16 the instantaneous value of the speed reference $v_{ref}$ of the elevator car, which value is formed as a function of the position s. The safety controller 17 always also again determines a threshold value $v_{lim}$ when the speed reference $v_{ref}$ changes as the position s of the elevator car 1 changes.

Also a corresponding scaling factor $k_2$ can be formed for the acceleration of the elevator car, e.g. from the maximum acceleration $a_{refmax}$ of the speed reference as well as from the corresponding measured acceleration $a_{max}$:

$$k_2 = \frac{a_{max}}{a_{refmax}}$$

In this case the threshold value $a_{lim}$ of acceleration can be formed by means of the speed reference and the scaling factor, using the following equation, wherein the threshold value $a_{lim}$ is 50 percent greater than the value calculated from the maximum acceleration $a_{refmax}$ of the speed reference:

$$a_{lim}=1.5*k_2*a_{ref\,max}$$

The maximum acceleration $a_{refmax}$ in the speed reference occurs at the start and at the end of a run, when the elevator car is accelerating in moving from the stopping floor and when braking at a stopping floor.

Of course, threshold values of different magnitudes for different drive modes/run speeds could also be determined by driving separate setup drives at different run speeds and by again determining in connection with each setup drive the threshold values in the setup drive on the basis of the measuring data for movement of the elevator car 1 received from the microcontroller 36 of the elevator car.

FIG. 3*a* presents a graph 4 of the speed of the elevator car 1 as a function of the position s of the elevator car, when the elevator car 1 starts to move from a terminal floor and stops at the opposite terminal floor. The threshold value 2 for the speed of the elevator car is formed in such a way that the threshold value 2 (continuous line) is a constant value that is 5 percent greater than the maximum speed 4 of the elevator car measured by the microcontroller 36 of the elevator car during the setup drive. In addition, FIG. 3*a* presents as a dashed line 2' the threshold value that is formed as a function of the speed reference $v_{ref}$ in such a way that the threshold value 2' changes as the speed reference changes in the proximity of the end zone of the elevator hoistway.

FIG. 3*b* correspondingly presents the graph of the acceleration 5 of the elevator car 1 during a setup drive, as a function of the position s of the elevator car 1. The threshold value 3 for the acceleration of the elevator car is formed in such a way that the threshold value 3 is 50 percent percent greater than the maximum acceleration of the elevator car 1 measured by the microcontroller 36 of the elevator car during the setup drive.

As stated in the preceding description, the safety controller 17 monitors the movement of the elevator car 1 by comparing the measuring data of the speed 4 and acceleration 5 of the elevator car being received from the microcontroller 36 of the elevator car to the set threshold values 2, 3, and if the measured speed 4/acceleration 5 of the elevator car 1 exceeds a threshold value 2, 3, the safety controller 17 performs the necessary procedures for bringing the elevator to a safe state. In one embodiment the safety controller 17 in this case disconnects the safety signal 6, in which case the machinery brakes 9 engage, the power supply to the electric motor 25 of the hoisting machine ceases and the elevator car 1 stops. After stopping the elevator car 1 returns to the stopping floor by driving with the hoisting machine 8 at a reduced speed. If the overspeed monitoring activates a number of times within a certain time, the safety controller 17 removes the elevator from use.

In another embodiment when the threshold value is exceeded the safety controller 17 sends a speed limiting command via the data transfer bus 18 to the frequency converter 16, on the basis of which command the frequency converter 16 drops the speed of the elevator car 1 but continues the run onwards to the original destination floor.

In a further developed embodiment the safety controller 17 forms two threshold values of different magnitudes for the speed of the elevator car 1. If the measured speed of the elevator car 1 exceeds the first of the threshold values, the safety controller disconnects the safety signal 6, and if the speed of the elevator car 1 further continues increasing also to the second larger threshold value, the safety controller 17 also activates the safety mechanism 12 of the elevator car. For this purpose a solenoid is fitted in connection with the rope pulley 27 of the overspeed governor 29, which solenoid is controlled with a control signal of the safety controller 17. The solenoid is configured to stop the movement of the rope pulley 27 with the control of the safety controller 17.

In FIG. 1 the frequency converter 16 as well as the contactors in the main circuit of the machinery brakes 9 are controlled with a safety signal 6. The control could also be implemented in other ways; the safety signal 6 could be e.g. connected to control electronics of the frequency converter 16 and also of the brake control circuit 11 in such a way that when disconnecting the safety signal 16 the passage of control pulses to the IGBT transistors of the frequency converter 16 as well as to the MOSFET transistors of the brake control circuit 11 ceases, in which case also the electricity supply to the electric motor 25 of the hoisting machine ceases and both machinery brakes 9 engage to brake the traction sheave 19.

FIG. 2 presents an automatic door of an elevator, said door comprising a safety arrangement according to the description that monitors the movement of the door panels 10. The door operator of the elevator car comprises an electric motor, preferably a brushless direct-current motor, which drives a traction sheave 30, which is connected to a traction belt 34. The door panels 10 are fixed to a traction belt 34 in such a way that the door panels 10 move, according to the direction of rotation of the traction sheave 30, either towards each other or away from each other, in which case the doors open or close.

The traction sheave 30 is rotated by supplying current to the electric motor with a frequency converter 32. The control unit 33 of the door of the elevator calculates a speed reference for the door panels, and the frequency converter 32 measures the speed of rotation of the traction sheave 30 with a pulse encoder 31 and adjusts the measured speed of the traction sheave 30 towards the speed reference by adjusting the current of the electric motor rotating the traction sheave 30.

The safety arrangement also comprises an electronic safety controller 17. Between the safety controller 17 and the frequency converter 32 is a data transfer bus 35, via which the safety controller 17 at regular intervals receives from the frequency converter 32 information on the measuring data of the encoder 31.

The safety controller 17 comprises a relay output for the safety signal 6. If necessary, the safety controller 17 brings the elevator to a safe state by disconnecting the aforementioned safety signal 6 by opening the contacts of a safety relay that is in the safety controller 17. When the safety signal 6 disconnects, the power semiconductors of the frequency converter 32 cease to conduct and the current supply to the electric motor rotating the traction sheave 30 ceases.

The safety controller 17 monitors that the movement of the traction sheave 30 follows the desired movement. The safety controller 17 compares the measuring data of the encoder 31 to the threshold value recorded in the memory of the safety controller 17. If the speed/acceleration of the traction sheave 30 indicated by the measuring data of the encoder 31 exceeds the threshold value recorded in memory, the safety controller 17 disconnects the safety signal 6.

The safety controller 17 forms the aforementioned threshold value in all essential respects in the same manner as was presented when describing the embodiment of FIG. 1. Consequently, before the elevator is taken into normal operation, a setup drive is run with the door operator of the elevator while subjected to monitoring by the safety controller 17. In the setup drive the door panels are driven in such a way that the doors are both opened and closed. The speed and acceleration of the door panels 10 during the setup drive can be according to FIGS. 3*a* and 3*b*.

The safety controller 17 also regularly receives from the data transfer bus 18 during the setup drive the measuring data of the encoder 31 and it records the measuring data received as a set of samples in the memory of the safety controller 17, in the same manner as has been described above. Taking the elevator into use is dependent on successfully passing the setup drive, i.e. the door panels have opened and closed normally, so an aborted setup drive must be performed again.

When the setup drive has been passed, the safety controller 17 takes into use the movement monitoring function according to the description. The safety controller 17 forms the threshold values needed in the monitoring function on the basis of the measuring data of the encoder 31 received in the setup drive.

The safety controller 17 sets the threshold value $v_{lim}$ for speed to be 5 percent greater than the maximum value $v_{max}$ of speed measured in the setup drive and the threshold value $a_{lim}$ for acceleration to be 50 percent greater than the maximum value $a_{max}$ of acceleration measured in the setup drive.

In a further developed embodiment the control unit 33 of the door sends to the safety controller 17 the value of the speed reference $v_{ref}$ from the even speed (maximum speed) run phase of the setup drive. The safety controller 17 calculates the scaling factor k specific to the door operator by means of the maximum value $v_{max}$ for speed and by means of the speed reference $v_{ref}$:

$$k = \frac{v_{max}}{v_{ref}}.$$

The safety controller determines the threshold value $v_{lim}$ for speed in such a way that the threshold value is 5 percent greater than $v_{max}$, in which case a description is obtained for the threshold value $v_{lim}$ as a function of the speed reference $v_{ref}$, using the scaling factor k as an aid:

$$v_{lim}=1.05*k*v_{ref}$$

The speed reference changes as a function $v_{ref}(s)$ of the position s of the door panels 10, in which case also the threshold value $v_{lim}$ can also be determined as a function of position s. This occurs in such a way that the safety controller 17 regularly receives from the control unit 33 the instantaneous value of the speed reference $v_{ref}(s)$. The safety controller 17 always also again determines a threshold value $v_{lim}$ when the speed reference $v_{ref}$ changes as a function of the position s of the door panels 10.

The invention is described above by the aid of a few examples of its embodiment. It is obvious to the person skilled in the art that the invention is not limited to the embodiments described above, but that many other applications are possible within the scope of the inventive concept defined by the claims presented below.

The safety controller 17 is not necessarily a separate unit, but instead it could also be integrated into e.g. a frequency converter 16, 32.

The invention claimed is:

1. A method for controlling the movement of an elevator component, said method comprising the steps of:

running a setup drive of an elevator component, wherein the setup drive is an initialization of the elevator component where the elevator component performs a complete operational cycle, and measuring the speed and/or acceleration of the elevator component during the setup drive;

forming a threshold value for the speed and/or acceleration of the elevator component on the basis of the measured speed and/or acceleration obtained in the setup drive;

measuring the speed and/or acceleration of the elevator component after the setup drive, and if the measured speed and/or acceleration exceeds the threshold value, forming a monitoring signal that monitors the speed and/or acceleration of the elevator component; and based on the monitoring signal, controlling the operation of the elevator component to bring the elevator component to a stopped position.

2. The method according to claim 1, further comprising the steps of:

forming a monitoring function for monitoring the movement of the elevator component;

initializing the monitoring function into a state in which the monitoring function is not in use;

determining one or more pass criteria for passing the setup drive; and taking the monitoring function into use after fulfilling the one or more pass criteria.

3. The method according to claim 1, further comprising the steps of:

ascertaining the maximum value during the setup drive of the measured speed and/or acceleration of the elevator component; and forming the threshold value for the speed and/or acceleration of the elevator component on the basis of the maximum value during the setup drive.

4. The method according claim 1, further comprising the steps of:

forming a speed reference for the elevator component for the setup drive;

adjusting the speed of the elevator component with the motor drive to be according to the speed reference during the setup drive;

forming a scaling factor, which connects the speed reference to the speed and/or acceleration during the setup drive; and forming a threshold value for the speed and/or acceleration of the elevator component as a function of the speed reference by means of the scaling factor.

5. The method according to claim 1, wherein the elevator component is an elevator car.

6. The method according to claim 5, further comprising the step of driving the setup drive by moving an elevator car from a terminal floor of the elevator hoistway and stopping at the opposite terminal floor.

7. The method according to claim 5, further comprising the step of starting an emergency stop of the elevator car on the basis of the monitoring signal.

8. The method according to claim 5, further comprising the steps of:

forming two threshold values of different magnitudes for the speed of the elevator car on the basis of the measuring data obtained in the setup drive;

if the measured speed of the elevator car exceeds the first threshold value, controlling the electric motor of the hoisting machine of the elevator and/or the machinery brakes of the hoisting machine for bringing the elevator car to the stopped position; and if the measured speed of the elevator car further exceeds the second, larger threshold value, activating a safety mechanism of the elevator car.

9. A safety arrangement of an elevator, comprising:

an elevator component, a movement measuring sensor, which is connected to measure the movement of the elevator component;

a motor drive for driving the elevator component;

a safety controller, which is connected to the motor drive for bringing the elevator to a stopped position; and a data transfer channel formed between the motor drive, the movement measuring sensor and the safety controller, the safety controller comprising a processor and a memory, in which is a program to be executed by the processor, in which program the safety controller is configured:

to receive from the movement measuring sensor measuring data about the speed and/or acceleration of the elevator component during the setup drive, wherein the setup drive is an initialization of the elevator component where the elevator component performs a complete operational cycle;

to form a threshold value for the speed and/or acceleration of the elevator component on the basis of the aforementioned measuring data;

to receive from the movement measuring sensor after the setup drive measuring data about the speed and/or acceleration of the elevator component, and if the measuring data being received in this case exceeds the threshold value; and to form a monitoring signal for bringing the elevator component to the stopped position.

10. The safety arrangement according to claim 9, wherein the elevator component is an elevator car.

11. The safety arrangement according to claim 10, wherein the safety controller is configured to start an emergency stop of the elevator car on the basis of the monitoring signal to be formed.

12. The safety arrangement according to claim 9, wherein the elevator component is an automatic door of an elevator.

13. The safety arrangement according to claim 9, wherein the movement measuring sensor is a position sensor and/or a speed sensor and/or an acceleration sensor.

14. The method according to claim 2, further comprising the steps of:

ascertaining the maximum value during the setup drive of the measured speed and/or acceleration of the elevator component; and forming a threshold value for the speed and/or acceleration of the elevator component on the basis of the maximum value during the setup drive.

15. The method according to claim 2, further comprising the steps of:

forming a speed reference for an elevator component for the setup drive;

adjusting the speed of the elevator component with a motor drive to be according to the speed reference during the setup drive;

forming a scaling factor, which connects the speed reference to the speed and/or acceleration during the setup drive; and forming a threshold value for the speed and/or acceleration of the elevator component as a function of the speed reference by means of the scaling factor.

16. The method according to claim 3, further comprising the steps of:

forming a speed reference of the elevator component for the setup drive;

adjusting the speed of the elevator component with a motor drive to be according to the speed reference during the setup drive;

forming a scaling factor, which connects the speed reference to the speed and/or acceleration during the setup drive; and forming a threshold value for the speed and/or acceleration of the elevator component as a function of the speed reference by means of the scaling factor.

17. The method according to claim 2, wherein the elevator component is an elevator car.

18. The method according to claim 3, wherein the elevator component is an elevator car.

19. The method according to claim 4, wherein the elevator component is an elevator car.

20. The method according to claim 6, further comprising the step of starting an emergency stop of the elevator car on the basis of the monitoring signal.

* * * * *